US007861789B2

(12) United States Patent
Nelson

(10) Patent No.: US 7,861,789 B2
(45) Date of Patent: Jan. 4, 2011

(54) METAL-TO-METAL SEAL FOR BRIDGING HANGER OR TIEBACK CONNECTION

(75) Inventor: John E. Nelson, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 580 days.

(21) Appl. No.: 11/348,201

(22) Filed: Feb. 6, 2006

(65) Prior Publication Data

US 2006/0191680 A1 Aug. 31, 2006

Related U.S. Application Data

(60) Provisional application No. 60/651,284, filed on Feb. 9, 2005.

(51) Int. Cl.
*E21B 7/12* (2006.01)
*E21B 33/00* (2006.01)
*F16L 3/00* (2006.01)

(52) U.S. Cl. ..... 166/348; 166/382; 166/85.3; 166/82.1; 166/86.1; 166/196; 277/322; 277/323; 277/334; 285/123.12

(58) Field of Classification Search ..... 166/368, 166/348, 344, 88.1, 382, 89.3, 345, 85.3, 166/86.1, 82.1, 115, 196; 277/322–344, 277/603, 626; 285/123.12, 80, 133.21, 91
See application file for complete search history.

(56) References Cited

U.S. PATENT DOCUMENTS 3,688,841 A * 9/1972 Baugh ..... 166/89.2
4,109,942 A * 8/1978 Morrill ..... 285/123.13
4,131,287 A * 12/1978 Gunderson et al. ..... 277/328
4,278,278 A * 7/1981 Chambless et al. ..... 285/123.12
4,353,560 A * 10/1982 Tohill ..... 277/328
4,384,730 A * 5/1983 Diehl ..... 277/322
4,496,162 A * 1/1985 McEver et al. ..... 277/336
4,550,782 A * 11/1985 Lawson ..... 166/382
4,569,540 A * 2/1986 Beson ..... 285/93
4,583,746 A * 4/1986 Lawson ..... 277/314
4,595,063 A * 6/1986 Jennings et al. ..... 166/382
4,690,221 A * 9/1987 Ritter, Jr. ..... 166/382

(Continued)

FOREIGN PATENT DOCUMENTS

EP 109541 A1 * 5/1984
GB 2408989 A * 6/2005

*Primary Examiner*—Thomas A Beach
(74) *Attorney, Agent, or Firm*—Bracewell & Giuliani

(57) ABSTRACT

A method of completing a well having a casing hanger set in a subsea wellhead housing includes attaching a running tool to a tubular bridging hanger. A metal-to-metal inner seal is attached to a lower exterior portion of the bridging hanger and a metal-to-metal outer seal is located on an upper exterior portion of the bridging hanger. The assembly is lowered into the well and the lower exterior portion of the bridging hanger is inserted into the casing hanger. The inner seal is wedged between the casing hanger and the bridging hanger in response to weight of the running string. The running tool is actuated to set the outer seal between the upper exterior portion of the bridging hanger and the wellhead housing. Then, a tubing hanger is landed and sealed in the interior of the bridging hanger.

20 Claims, 4 Drawing Sheets

U.S. PATENT DOCUMENTS 4,691,780 A * 9/1987 Galle et al. ..... 166/348
4,719,971 A * 1/1988 Owens ..... 166/191
4,742,874 A * 5/1988 Gullion ..... 166/348
4,751,965 A * 6/1988 Cassity ..... 166/182
4,771,828 A * 9/1988 Cassity ..... 166/115
4,790,572 A * 12/1988 Slyker ..... 285/123.12
4,815,770 A * 3/1989 Hyne et al. ..... 285/123.12
4,832,381 A * 5/1989 Boulton ..... 277/621
4,900,041 A * 2/1990 Hopkins et al. ..... 277/328
4,928,769 A 5/1990 Milberger et al.
5,025,864 A * 6/1991 Nobileau ..... 166/348
5,076,356 A * 12/1991 Reimert ..... 166/115
5,110,144 A * 5/1992 Burton et al. ..... 277/328
5,129,660 A * 7/1992 Taylor et al. ..... 277/328
5,174,376 A * 12/1992 Singeetham ..... 166/208
5,325,925 A * 7/1994 Smith et al. ..... 166/387
5,450,905 A * 9/1995 Brammer et al. ..... 166/348
5,464,063 A 11/1995 Boehm, Jr.
6,176,310 B1 * 1/2001 Smith et al. ..... 166/89.1
6,293,345 B1 * 9/2001 Watkins ..... 166/368
6,474,417 B1 * 11/2002 Blair et al. ..... 166/368
6,510,895 B1 * 1/2003 Koleilat et al. ..... 166/208
6,547,009 B2 * 4/2003 Vick, Jr. ..... 166/368
6,550,537 B1 * 4/2003 Alvarez et al. ..... 166/348
6,668,919 B2 * 12/2003 Radi ..... 166/208
7,025,360 B2 * 4/2006 Walker et al. ..... 277/652
7,073,591 B2 * 7/2006 Massie et al. ..... 166/348
7,117,945 B2 * 10/2006 Hopper et al. ..... 166/348
2002/0170721 A1 11/2002 June
2003/0006041 A1 1/2003 Baten et al.
2003/0121667 A1 * 7/2003 Massie et al. ..... 166/344
2004/0238175 A1 12/2004 Wade et al.
2004/0251031 A1 * 12/2004 Reimert ..... 166/368
2005/0139360 A1 6/2005 Van Bilderbeek
2006/0196673 A1 * 9/2006 Pallini et al. ..... 166/368
2006/0272823 A1 * 12/2006 Hopper et al. ..... 166/368
2008/0006412 A1 * 1/2008 Ford ..... 166/368

* cited by examiner

METAL-TO-METAL SEAL FOR BRIDGING HANGER OR TIEBACK CONNECTION

CROSS-REFERENCE TO RELATED APPLICATION

This application claims priority to provisional application 60/651,284, filed Feb. 9, 2005.

FIELD OF THE INVENTION

This invention relates in general to subsea wellhead equipment and in particular to a metal-to-metal seal for a bridging hanger or tieback connection.

BACKGROUND OF THE INVENTION

A subsea well assembly includes a wellhead housing that is secured to large diameter conductor pipe extending to a first depth in the well. After drilling to a second depth, a string of casing is lowered into the well and suspended in the wellhead housing by a casing hanger. A packoff seals between an outer diameter portion of the casing hanger and the bore of the wellhead housing. Some wells have two or more strings of casing, each supported by a casing hanger in the wellhead housing.

In one type of completion, a string of production tubing is lowered into the last string of casing. A tubing hanger lands and seals in the upper casing hanger. The well is produced through the tubing. Prior to running the tubing, the operator will test the upper casing hanger packoff. On rare occasions, the packoff may be unable to pass the pressure test, possibly due to damage on the interior wall of the wellhead housing. If so, one remedy is to install an emergency or bridging hanger in the wellhead housing. The bridging hanger does not support a string of casing, but has an interior profile that is normally the same as the profile in the upper casing hanger. The operator lands and seals the lower portion of the bridging hanger to the casing hanger. The operator installs a packoff between the upper exterior portion of the bridging hanger and the wellhead housing above the casing hanger. The operator then runs the tubing and lands and seals the tubing hanger in the bridging hanger.

In the prior art, the inner seal between the bridging hanger and the casing hanger is normally elastomeric. As the bridging hanger enters the casing hanger, the elastomeric seal deforms to cause the sealing engagement. Metal-to-metal outer seals or packoffs have been used for years because they can withstand higher pressures than elastomeric seals and also do not deteriorate under harsh environments as readily. Metal-to-metal tubing hanger seals are also employed in many wells. A metal-to-metal seal, however, typically requires much more force to set than simply the weight of the running string. Various running tools have been developed to apply the high forces needed. Developing a running tool to set a metal-to-metal inner seal would require an additional trip down the riser with another running tool to set the metal-to-metal outer seal. In offshore wells, particularly in deep water, it is very expensive to run an additional trip.

SUMMARY OF THE INVENTION

In this invention, a metal-to-metal inner seal is attached to the lower exterior portion of the bridging hanger. The bridging hanger is lowered on a running tool into the wellhead housing and inserted into the casing hanger. The inner seal is set between the interior of the casing hanger and the lower exterior portion of the bridging hanger in response to the weight of the running string. Preferably, the inner seal has a deflectable locking portion to lock the inner seal in the preload caused by the weight of the running string. The weight causes the locking portion to defect outward into engagement with a profile in the casing hanger.

In one embodiment, while the running tool is still inserted into the wellhead housing, the running tool is actuated to set a metal-to-metal outer seal between the upper exterior portion of the bridging hanger and the wellhead housing. The bridging hanger may be used in place of the casing hanger to support a string of tubing. If so, the tubing hanger lands in and seals to the interior of the bridging hanger

DETAILED DESCRIPTION OF THE INVENTION

Figure 1:
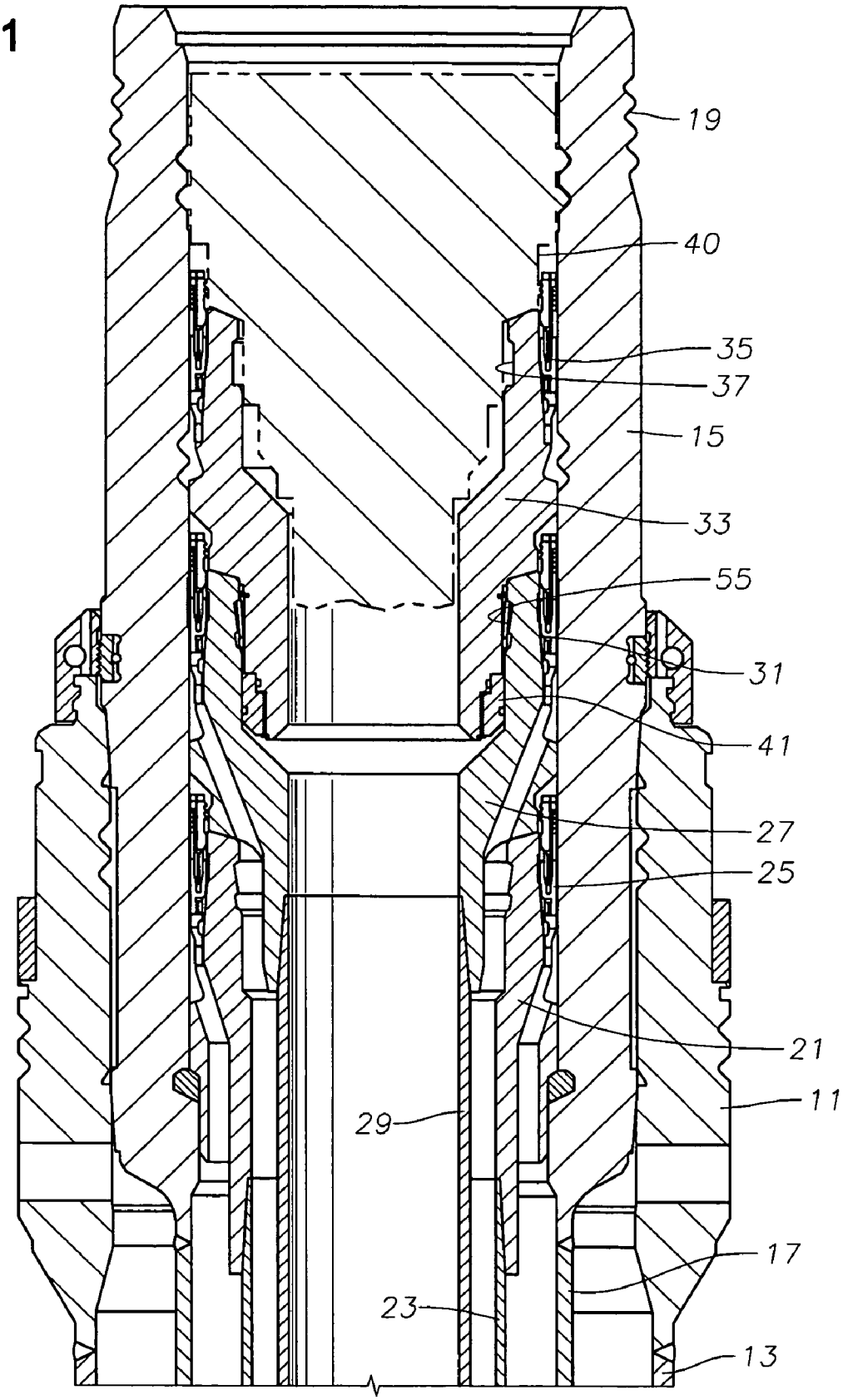
FIG. 1 is a vertical sectional view of a subsea wellhead assembly having a bridging hanger with a metal-to-metal seal in accordance with this invention.

Referring to FIG. 1, the subsea wellhead assembly in this embodiment includes an outer or low pressure wellhead housing 11. A string of conductor pipe 13 is attached to the lower end of low pressure wellhead housing 11 and extends into a first section of the well. A high pressure or outer wellhead housing 15 lands in low pressure wellhead housing 11. High pressure wellhead housing 15 is secured to a string of casing 17 that extends through conductor pipe 11 to a greater depth in the well. High pressure wellhead housing 15 has an exterior grooved profile 19 for engagement by a drilling riser assembly that extends to a surface vessel.

After drilling the well through high pressure wellhead housing 15 to a greater depth, a next section of casing 23 is run on a casing hanger 21. Casing hanger 21 lands in high pressure wellhead housing 15. A packoff or casing hanger seal 25 seals the annulus around casing hanger 21 to high pressure wellhead 15. Some wells may have only one casing hanger such as casing hanger 21. In this example, an additional casing hanger 27 is shown, casing hanger 27 being attached to a string of production casings 29 that extends to a final depth in the well. A casing hanger seal 31 seals between the outer diameter of the upper casing hanger 27 and the bore of wellhead housing 15.

Figure 2:
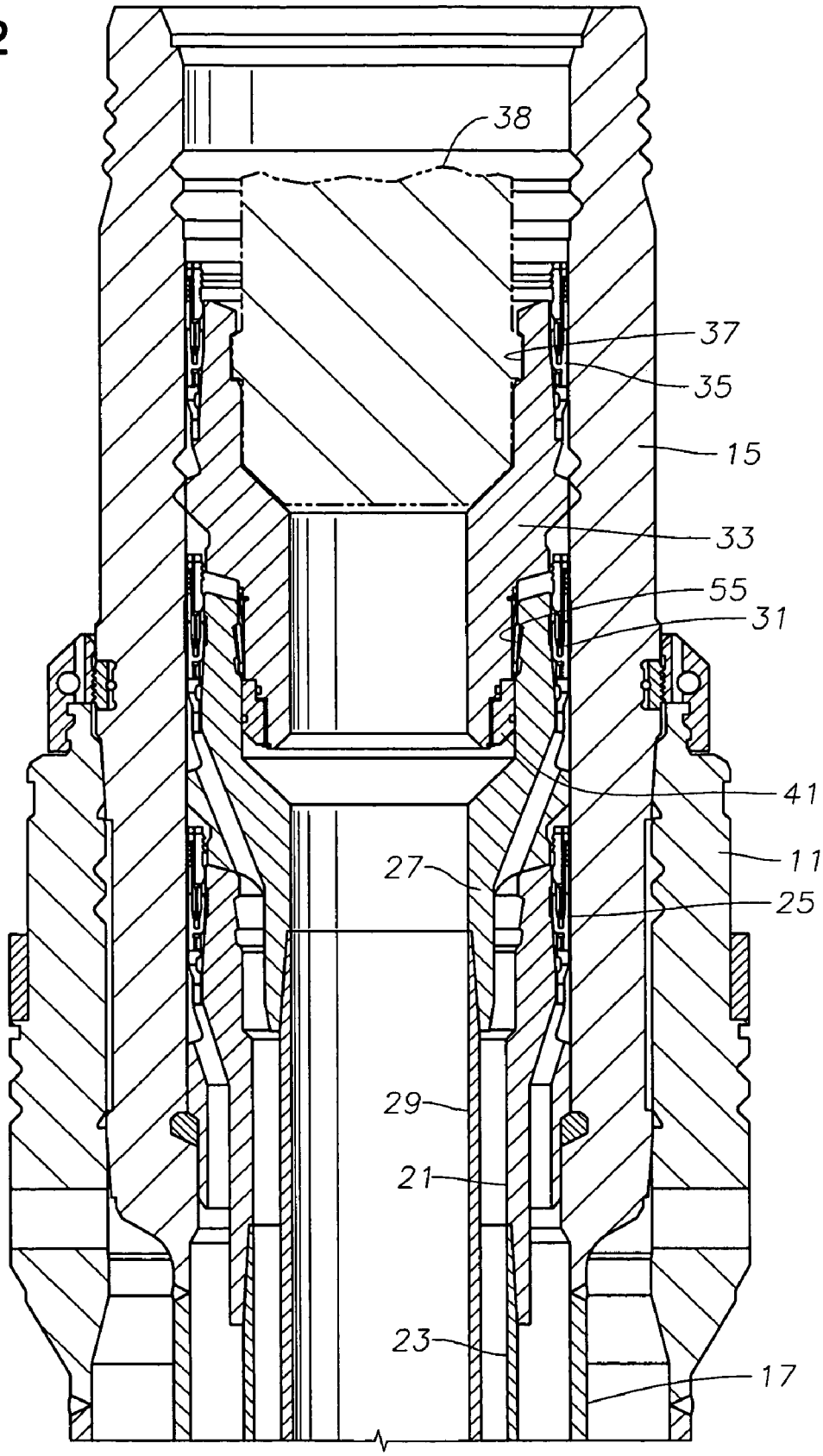
FIG. 2 is an enlarged sectional view of the wellhead assembly of FIG. 1, showing the bridging hanger being run in prior to energizing the metal-to-metal seal.

A bridging hanger 33 is shown landed on production casing hanger 27. Bridging hanger 33 would be employed in the event that upper casing hanger seal 31 could not be installed or if it leaked. Bridging hanger 33 has an interior or bore substantially identical to bore 39 of production casing hanger 27 in this example. Bridging hanger 33 has a structure similar to casing hanger 27, except there is no provision for securing casing to its lower end. A casing hanger outer seal 35, which may be identical to casing hanger seals 25 and 31, seals the annulus around bridging hanger 33 to wellhead housing 15. Bridging hanger 33 has an interior grooved profile 37 that is engaged by a conventional casing hanger running tool 38, illustrated in FIG. 2 by dotted lines. Running tool 38 carries outer seal 35, and after bridging hanger 33 lands, moves outer seal 35 downward and sets it. Bridging hanger 33 may subsequently support a conventional tubing hanger 40, shown by dotted lines in FIG. 1. Tubing hanger 40 has a seal 42 that sealingly engages a sealing surface in bridging hanger 33 below profile 37.

Figure 3:
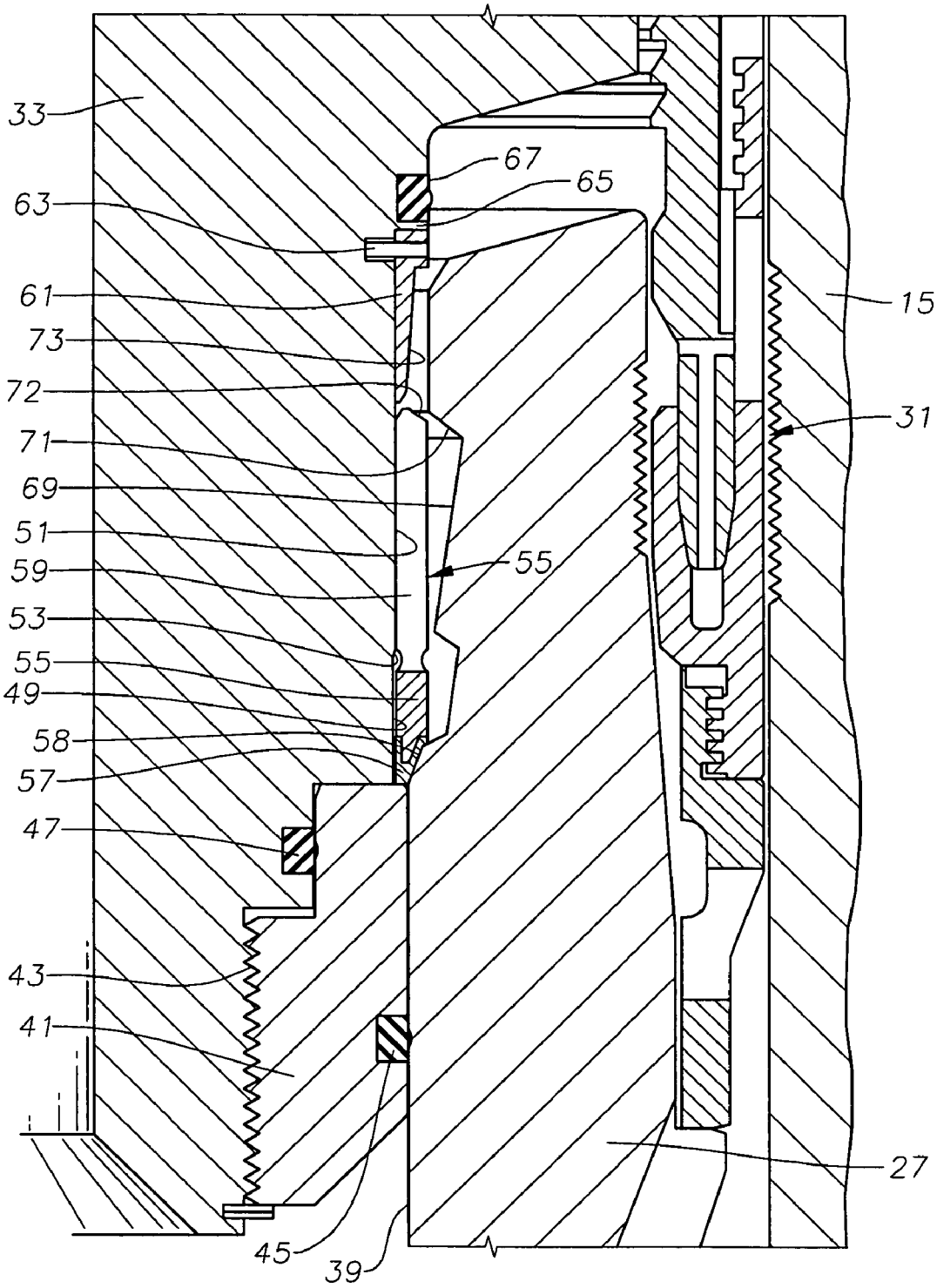
FIG. 3 is a further enlarged view of a portion of the bridging hanger of FIG. 2, showing the metal-to-metal seal prior to being energized.

Referring to FIG. 3, bridging hanger 33 is shown being lowered into bore 39 of production casing hanger 27, but running tool 38 (FIG. 2) is not shown for clarity. Bridging hanger 33 has a retainer ring 41 on its lower end that is secured by threads 43. Preferably, retainer ring 41 has a backup elastomeric seal 45 that seals against a portion of production casing hanger bore 39. Retainer ring 41 also has an inner seal 47 that seals to an exterior portion of bridging hanger 33 above threads 43. The body of bridging hanger 33 has a guide portion 49 on its outer diameter that is cylindrical and has an outer diameter less than the outer diameter of retainer ring 41. A seal surface 51 is formed on the outer diameter of the body of bridging hanger 33 above guide portion 49. Seal surface 51 is finished to a desired metal-to-metal surface finish, such as 32 RMS. Seal surface 51 has an outer diameter that is slightly greater than the outer diameter of guide portion 49, but less than the outer diameter of retainer ring 41. A transition shoulder 53 is located between seal surface 51 and guide portion 49.

A bridging hanger seal ring 55 is carried on the outer diameter of bridging hanger 33 above retainer ring 41. Seal ring 55 has a metal seal 57 on its lower end. In this embodiment, metal seal 57 comprises a welded inlay of a conventional type of material suitable for forming metal-to-metal seals. For example, the inlay may be a nickel-base alloy. Metal seal 57 has a cylindrical surface on its inner diameter and a downward facing tapered surface on its outer diameter. The tapered surface mates with a tapered seal surface 58 formed in bore 39 of production casing hanger 27. Seal surface 58 is prepared for metal-to-metal sealing, having a finish substantially the same as seal surface 51 on bridging hanger 33. In this embodiment, tapered seal surface 58 is formed at taper angle, such as 20 degrees, that is considerably larger than a locking taper, which is typically about 7½ degrees. Seal surface 51 on the exterior portion of bridging hanger 33 is cylindrical in this example.

Figure 4:
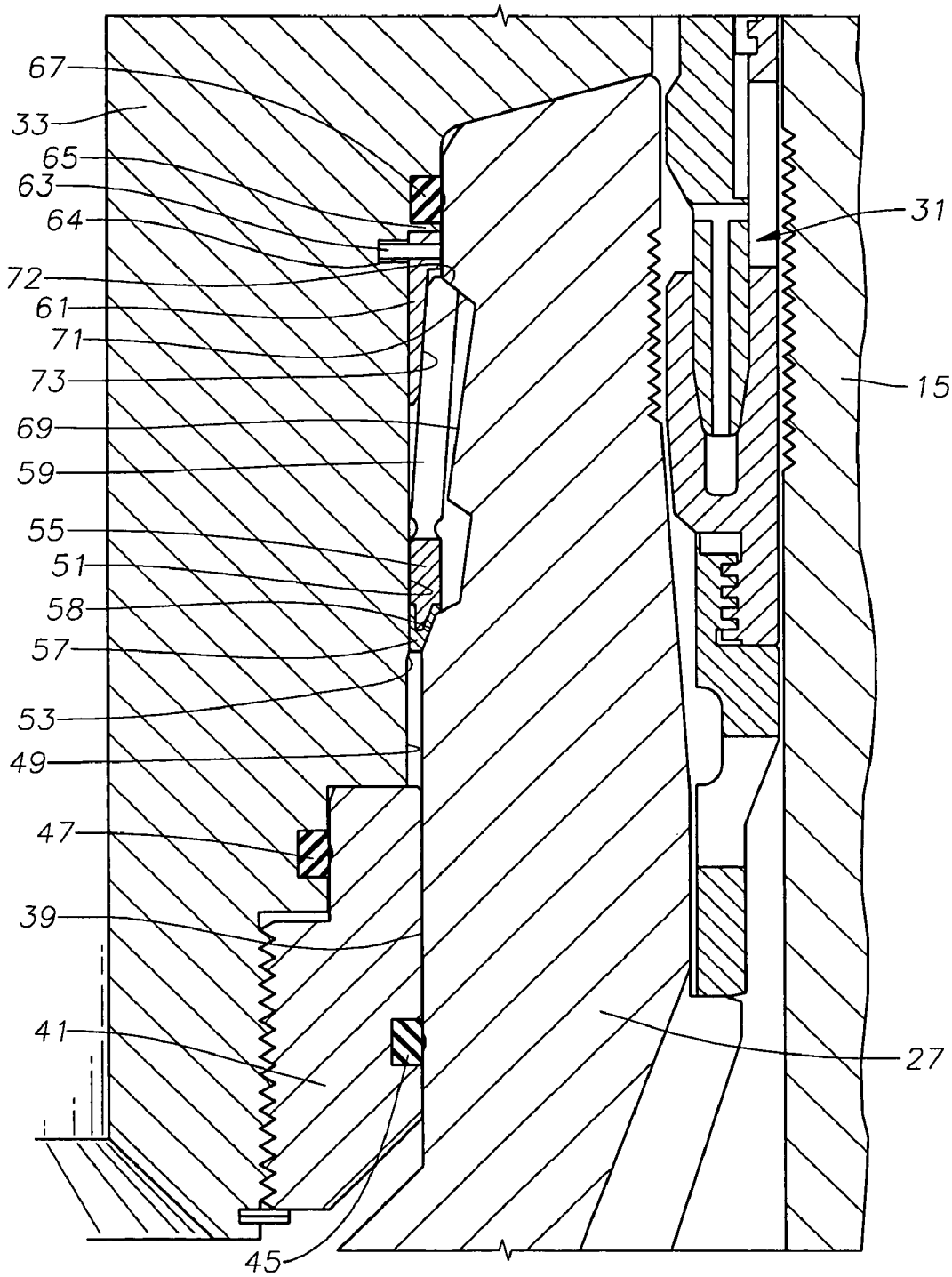
FIG. 4 is a view similar to FIG. 3, but showing the seal in the energized position.

Seal ring 55 has a plurality of vertical slots (not shown) spaced circumferentially apart from each other, defining a collet section with collet fingers 59. The slots extend through the upper end of seal ring 55, thus collet fingers 59 are not connected to each other at their upper ends. The individual fingers 59 with free upper ends enable the upper portion of seal ring 55 to plastically deflect outwardly from a cylindrical configuration to a conical configuration, as shown in FIG. 4. In the running-in position shown in FIG. 3, fingers 59 are located around seal surface 51 of the body of bridging hanger 33. Seal ring 55 may be made of any suitable metal, such as Inconel 718.

A drive or cam ring 61 is secured to bridging hanger 33 above seal ring 55. Drive ring 61 has an upper end that abuts a downward facing shoulder 65 on the outer diameter of bridging hanger 33. Preferably, a plurality of fasteners 63 may be used to secure ring 61 and prevent it from sliding downward. Fasteners 63 insert into oversized holes 64 in bridging hanger 33 in the preferred embodiment. Thermal changes that cause axial cyclic deflections will not be transferred through fasteners 63 due to a clearance provided between fasteners 63 and holes 64. Up and down movement between casing hanger 27 and bridging hanger 33 will not loosen drive ring 61.

An upper backup seal 67 is optionally located above drive ring 61. Upper backup seal 67 is positioned to engage an upper portion of bore 39 of production casing hanger 27. Production casing hanger 27 has a grooved profile 69 formed in an upper portion of bore 39 above the cylindrical portion that normally is prepared for sealing engagement with tubing hanger seal 42 (FIG. 1). Profile 69 may take a variety of shapes and is typically used for engagement with running tool 38 (FIG. 2) to run casing hanger 27. Also, profile 69 may be used for securing a lock member of a tieback assembly (not shown) when tubing hanger 40 (FIG. 1) is not utilized. Profile 69 has a downward and inward facing conical reaction shoulder 71 at its upper edge or end. Tapered seal surface 58 defines the lower edge of profile 69.

Collet fingers 59 of seal ring 55 have mating conical upper ends 72 that engages shoulder 71 when deflected outward as shown in FIG. 4. Drive ring 61 has an outer tapered surface 73 that engages the inner diameter of fingers 59 of seal ring 55 to cause collet fingers 59 to deflect outward when drive ring 61 moves downward relative to seal ring 55. The amount of taper is selected to provide a locking taper to resist upward movement of drive ring 61 relative to seal ring 55 once engaged.

In operation, the operator connects running tool 38 (FIG. 2) to bridging hanger 33 and lowers it through a drilling riser into high pressure wellhead housing 15. Initially, retainer ring 41 will slide into bore 39 of production casing hanger 27, as shown in FIG. 3. Metal seal 57 of seal ring 55 will land on tapered seal surface 58 in bore 39 of production casing hanger 27. At this point, the inner diameter of seal ring 55 at collet fingers 59 remains cylindrical.

Then, continued weight is applied to bridging hanger 33 from the running string, causing bridging hanger 33 to move downward. As shown in FIG. 4, metal seal 57 remains in the same axial position while the body of bridging hanger 33 moves downward. Bridging hanger seal surface 51 slides into contact with the inner diameter of metal seal 57. Drive ring 61 slides between the inner surfaces of collet fingers 59 and the outer diameter of bridging hanger 33. Tapered surface 73 of drive ring 61 pushes collet fingers 59 outward. Drive ring 61 and collet fingers 59 lock at taper 73. Tapered upper ends 72 of fingers 59 slide into engagement with reaction shoulder 71 and lock at this point, also. The locking engagement of fingers 59 pre-loads seal ring 57 at seal surface 58. Any axial motion thereafter must be transmitted through collet fingers 59.

Metal-to-metal sealing engagement occurs on both sides of metal seal 57. Elastomeric seals 45, 47 and 67 provide a secondary backup. The sealing engagement is prevented from movement because of the engagement of tapered upper ends 72 of fingers 59 with reaction shoulder 71. Subsequently and on the same trip, running tool 38 (FIG. 2) conventionally installs bridging hanger seal 35 (FIG. 1), sealing the annulus around bridging hanger 33.

If the operator wishes to retrieve bridging hanger 33, he reengages running tool 38 with profile 37 (FIG. 1) and pulls upward. This causes drive ring 61 to move above seal ring 55 as shown in FIG. 3. The upper end of retainer ring 41 pushes upward on metal seal 57, causing upper ends 72 of fingers 59 to slide out of engagement with reaction shoulder 71 for retrieval.

After the installation shown in FIG. 1, bridging hanger 33 can serve in place of production hanger 27 for receiving tubing hanger 40 (FIG. 1). Alternately, bridging hanger 33 could receive an isolation sleeve, which forms part of a tubing hanger assembly. The tubing hanger could thus be supported in a tubing spool (not shown) mounted on high pressure wellhead housing 15. Further, bridging hanger 33 could receive an isolation tube suspended from a Christmas tree of a type where the tubing hanger is located within the tree. In that instance, the isolation tube would be considered to be part of the tubing hanger assembly.

Alternately, bridging hanger 33 could form the lower end of a tieback connector (not shown), which stabs and locks into production casing hanger 27 and is located at the lower end of a string of conduit extending to the surface. If bridging hanger 33 is part of a tieback connector, it typically would not need an outer annulus seal such as seal 35. The conduit extending upward from such a tieback connector would extend to a surface vessel for receiving a production tree.

The invention has significant advantages. The bridging hanger utilizes a metal-to-metal inner seal, while is longer lasting than elastomeric seals and better able to withstand high pressures. The inner and outer seals are run on the same trip. A special purpose running tool for the inner seal is not required.

While the invention has been shown in only one of its forms, it should be apparent to those skilled in the art that it is not so limited but is susceptible to various changes without departing from the scope of the invention.

The invention claimed is:

1. A method of completing a well having a casing hanger secured to a string of casing and set in a subsea wellhead housing to support the string of casing, comprising:

(a) providing a tubular bridging hanger, the tubular bridging hanger being adapted to support a tubular hanger and not secured to a string of casing or tubing, with a lower exterior portion and an upper exterior portion having a larger outer diameter than the lower exterior portion;

(b) attaching a metal-to-metal inner seal to the lower exterior portion;

(c) lowering the bridging hanger on a running tool and running string into the wellhead housing, inserting the lower exterior portion into an interior of the casing hanger and by applying weight of the running string, setting the metal-to-metal inner seal between the interior of the casing hanger and the lower exterior portion of the bridging hanger and deflecting a plurality of inner seal portions outward to a conical configuration received within a recessed profile in the casing hanger.

2. The method according to claim 1, further comprising:

while the running tool is still inserted into the wellhead housing, setting a metal-to-metal outer seal between the upper exterior portion of the bridging hanger and the wellhead housing.

3. The method according to claim 1, wherein deflecting a plurality of inner seal portions outward to a conical configuration received within a recessed profile in the casing hanger locks the inner seal to the interior of the casing hanger.

4. The method according to claim 1, wherein deflecting a plurality of inner seal portions outward to a conical configuration received within a recessed profile in the casing hanger prevents upward axial movement of the inner seal relative to the casing hanger by positioning the plurality of inner seal portions to engage a downward-facing shoulder of the casing hanger.

5. The method according to claim 1, wherein step (c) comprises wedging the inner seal between surfaces on the bridging hanger and casing hanger that incline relative to each other at an angle greater than a locking taper angle.

6. The method according to claim 1, further comprising after step (d), attaching a string of tubing to a tubing hanger assembly, lowering the tubing through the bridging hanger and sealing a lower portion of the tubing hanger assembly to a seal surface in the interior of the bridging hanger.

7. The method according to claim 1, wherein the interior of the casing hanger has a conventional seal area, and wherein step (c) comprises setting the inner seal in a place other than the conventional seal area.

8. The method according to claim 1, wherein the bridging hanger has a minimum inner diameter that is substantially equal to a minimum inner diameter of the casing hanger.

9. A method of completing a well having a casing hanger set in a subsea wellhead housing, but unable to form a seal in the annulus between the casing hanger and the subsea wellhead housing in a first seal area of the subsea wellhead housing, comprising:

(a) attaching a running tool to a tubular bridging hanger adapted to be disposed atop the casing hanger to enable a seal to be formed between the bridging hanger and the subsea wellhead in a second seal area of the subsea wellhead housing above the first seal area, the bridging hanger having a lower exterior portion and an upper exterior portion having a larger outer diameter than the lower exterior portion;

(b) attaching a metal-to-metal inner seal with a deformable lock portion to the lower exterior portion of the bridging hanger and engaging a metal-to-metal outer seal with the running tool;

(c) lowering the bridging hanger and running tool on a running string into the wellhead housing, inserting the lower exterior portion into an interior of the casing hanger and wedging the metal-to-metal inner seal between the interior of the casing hanger and the bridging hanger in response to weight of the running string so that a metal seal is formed between the metal-to-metal seal and the casing hanger and a metal seal is formed between the metal-to-metal seal and the bridging hanger and the deformable lock portion is deformed outward into engagement with the reaction shoulder; and (d) while still attached to the bridging hanger, actuating the running tool to set the outer seal between the upper exterior portion of the bridging hanger and the wellhead housing in the second seal area of the subsea wellhead housing.

10. The method according to claim 9, wherein the interior of the casing hanger has a conventional seal area, and wherein step (c) comprises setting the inner seal above the conventional seal area.

11. The method according to claim 9, wherein step (c) comprises wedging the inner seal between surfaces on the bridging hanger and casing hanger that incline relative to each other at an angle greater than a locking taper angle.

12. A subsea well assembly, comprising:

a wellhead housing having a bore;

a casing hanger landed in the wellhead housing, the casing hanger having an annular recess with a downward facing shoulder on an upper edge and a tapered surface on a lower edge;

a bridging hanger having a lower portion and an upper portion, the lower portion being inserted into the casing hanger and having a smaller outer diameter than the upper portion;

a metal ring having a lower portion that wedges in metal-to-metal sealing engagement between the tapered surface of the annular recess and an exterior portion of the bridging hanger to define the inner seal; and the metal ring having an upper portion that is deflected outward into the recess below the downward facing shoulder to lock the metal ring to the casing hanger.

13. The assembly according to claim 12, further comprising:

a metal-to-metal outer seal between the upper portion of the bridging hanger and the bore of the wellhead housing.

14. The assembly according to claim 12, wherein the bridging hanger has a minimum inner diameter that is substantially the same as a minimum inner diameter of the casing hanger.

15. The assembly according to claim 12, further comprising a tubing hanger assembly sealed in an interior portion of the bridging hanger.

16. The assembly according to claim 12, wherein the inner seal has inner and outer seal surfaces that taper relative to each other.

17. The assembly according to claim 12, wherein the inner and outer seal surfaces of the inner seal taper at an angle greater than a locking taper angle.

18. The assembly according to claim 12, further comprising:

a cam surface on the bridging hanger that deflects the upper portion of the metal ring outward in response to downward movement of the bridging hanger after the after the lower portion of the metal ring is wedged between the annular recess and exterior portion of the bridging hanger.

19. A subsea well assembly, comprising:

a casing hanger having an inner profile with a downward facing shoulder and a tapered surface;

a bridging hanger having a lower portion and an upper portion, the lower portion being adapted to be inserted into the casing hanger and having a smaller outer diameter than the upper portion;

a seal, comprising:

a metal ring having a lower portion adapted to wedge into metal-to-metal sealing engagement between the tapered surface of the casing hanger and an exterior portion of the bridging hanger; and a plurality of members adapted to be deflected by a portion of the bridging hanger outward into a conical configuration whereby upward axial movement of the seal relative to the casing hanger is opposed by engagement between the plurality of members and the downward facing shoulder of the casing hanger.

20. The wellhead assembly as recited in claim 19, wherein the bridging hanger comprises a tapered surface adapted to drive the plurality of members outward as the bridging hanger is displaced axially relative to the seal.

* * * * *